United States Patent [19]

Belsinger et al.

[11] Patent Number: 4,759,303

[45] Date of Patent: Jul. 26, 1988

[54] PRESSER FOOT LUBRICATION SYSTEM

[76] Inventors: Jack S. Belsinger, 1208 Marietta Ave., Lancaster, Pa. 17603; John C. Smith, R.D. #3, Box 527, York, Pa. 17402

[21] Appl. No.: 132,026

[22] Filed: Dec. 14, 1987

[51] Int. Cl.[4] ..... D05B 71/00; D05B 29/12

[52] U.S. Cl. ..... 112/256; 112/235

[58] Field of Search ..... 112/235, 256, 43; 604/414

[56] References Cited

U.S. PATENT DOCUMENTS

| | | | |
|---|---|---|---|
| 477,379 | 6/1892 | Morgan | 112/256 |
| 2,316,647 | 4/1943 | Giglio | 112/43 X |
| 2,442,222 | 5/1948 | Uccellini | 112/43 |
| 2,630,089 | 3/1953 | Champlin | 112/235 |
| 3,568,615 | 3/1971 | Stretton | 112/43 X |
| 4,392,850 | 7/1983 | Elias et al. | 604/414 X |
| 4,548,606 | 10/1985 | Larkin | 604/414 |

FOREIGN PATENT DOCUMENTS

| | | | |
|---|---|---|---|
| 775768 | 5/1957 | United Kingdom | 112/43 |

*Primary Examiner*—Andrew M. Falik

*Attorney, Agent, or Firm*—Daniel J. O'Connor

[57] ABSTRACT

A sewing machine presser foot lubrication system which includes apparatus to directly supply a lubricating fluid to the underside of a presser foot. The apparatus includes a small lubricant flow tube attached to a forwardmost underside portion of the presser foot. By such direct attachment of the lubricant flow line to the presser foot, a more effective lubricating function between the presser foot and a work piece is achieved. The apparatus further consists of a lubricant reservoir and the appropriate valving to control the lubricant flow rate therefrom. The flow tube is in two sections wherein a flexible second portion can be quickly disconnected from a rigid first portion which is integral with the presser foot.

1 Claim, 1 Drawing Sheet

PRESSER FOOT LUBRICATION SYSTEM

BACKGROUND OF THE INVENTION

Figure 1:
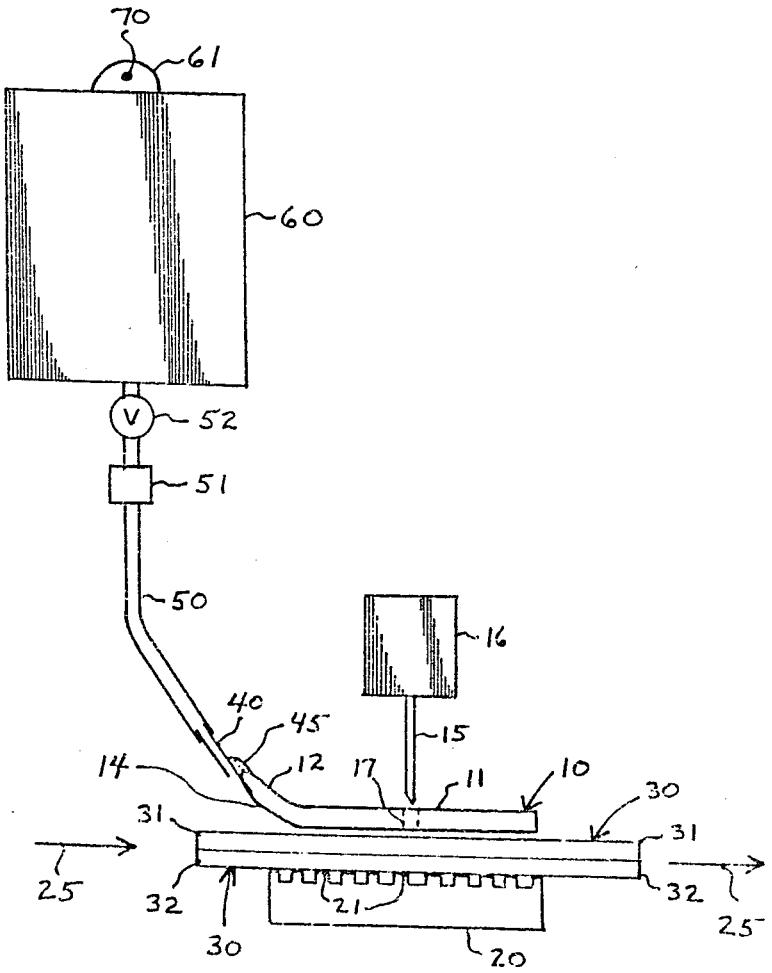

This invention relates generally to the sewing machine arts and, in particular, to the portion of a sewing machine known as a presser foot.

Typical state of the art sewing machines utilize lower feeder devices and at least one upper presser foot to convey material to be sewn into the needle stitching area.

When two-ply or heavier materials are being sewn, the need often arises to lubricate the presser foot to keep the material from being bunched up. When such bunching does occur, the operator must slow the sewing rate or, in the worst case, the material is damaged, yielding an unusable product.

To accomplish the desired presser foot lubrication, it is known to use a silicone lubricating spray fluid from a conventional aerosol spray can. In using this spray method, however, the machine operator is required to repeatedly reach for the lubricating container and manually spray fluid onto the presser foot. Such manual lubrication method obviously results in a lower operator work rate.

Older prior art systems have attempted to achieve lubrication of a sewing machine presser foot as evidenced by U.S. Pat. Nos. 2,630,089 and 2,442,222.

In the Champlin U.S. Pat. No. 2,630,089, lubricating fluid is supplied by dripping it onto a sponge 16. The sponge 16 must then be squeezed by a clip 13 to accomplish the lubricating function. Even with the complex Champlin system, the front tip of the presser foot receives no lubrication.

The Uccellini U.S. Pat. No. 2,442,222 shows the use of a costly wick or brush system in which the presser foot must have specially machined ducts 20 formed therein and also a specially made reservoir 21 must be machined for each presser foot.

Such specialized systems as shown by Champlin and Uccellini are clearly not practical in today's market wherein literally hundreds of different presser feet are sold to accomplish specific desired results.

Accordingly, it is an object of the present invention to produce a presser foot lubrication system which does away with the need for the manual spray lubrication methods currently in use.

It is a further object of the invention to demonstrate a presser foot lubrication system which may be easily adapted to any presser foot without the need for the specialized and costly modifications shown in the prior art.

It is also an object to demonstrate a system wherein the entire presser foot, including the front tip, is efficiently lubricated.

It is a further object of the invention to demonstrate a presser foot lubrication system which has utility for all types of materials sewn, i.e. two-ply materials, plastics, rough materials, rubber compounds and materials having glue thereon from a prior screen printing process.

It is a still further object of the invention to produce a presser foot lubrication method having an efficient means of lubricant flow control by the operator in addition to a quick disconnect of the system when desired.

It is another object of the invention to provide a presser foot lubricating system which may be adapted for use with a liquid silicone lubricant or a compressed air lubricating means. These and other objects of the invention will become apparent to those of skill in the art in the specification which follows.

PRIOR ART PATENTS

As noted above, the most relevant prior art known to the applicants herein is shown in U.S. Pat. Nos. 2,630,089 (Champlin) and 2,442,222 (Uccellini).

The above patents require a higher lubricant flow rate in order to fully saturate the sponge or brush elements used therein. In contrast, the design of the present system results in less required lubricant.

In FIG. 4 of the Champlin patent, it is clearly shown that lubricant drips from upper tube 23 onto the sponge 16. Although a splash guard 12 is used, the rapid up-and-down motion of the presser foot will inherently result in significant splashing of lubricating fluid onto the material being sewn which is, of course, an undesired result.

The Uccellini patent uses a brush 19 to apply lubricant directly to the fabric. Any clogging of flow through brush 19, which will inevitably occur, may result in insufficient lubrication or, in the worst case, excess quantities of lubricant being deposited on portions of the fabric.

Both the sponge system of Champlin and the brush system of Uccellini will be subject to clogging at regular intervals meaning that the system must be cleaned. During such cleaning period, the entire sewing machine is out of service due to the designs of the Champlin and Uccellini systems. Such extensive down-time is of course unacceptable for both industrial and domestic uses. Such drawbacks are the principle reasons why the prior art patented systems have not found widespread commercial acceptance.

In contrast, as will be shown herein the present inventive system may be easily and quickly disconnected from the sewing machine when required. Importantly, the sewing machine may continue to be used even when the lubricating system is being serviced or adjusted, thus resulting in much less machine down-time.

As will be readily apparent to those of skill in the art, the complexities of Champlin and Uccellini mean that they will not be adaptable to all presser feet or sewing machine systems. In contrast, the present invention is usable with all currently known presser feet systems.

As will be seen in the description which follows, the present invention is readily adaptable for use with compressed air as the lubricating fluid by reason of a direct connection between lubricant tubing and the front end of a presser foot. In contrast, compressed air would not be useable in Champlin by reason of remote tubing 23 or in Uccellini by reason of the use and orientation of brush 19.

BRIEF DESCRIPTION OF THE DRAWING FIGURE

FIG. 1 shows a side view, in schematic form, of the principles and elements of the present invention.

FULL DESCRIPTION OF THE PREFERRED EMBODIMENT

Referring now to FIG. 1, the inventive principles are illustrated in conjunction with material 30 having an upper layer 31 and a lower layer 32.

As is known in the art, material 30 is pulled to the right (as indicated by arrows 25 in FIG. 1) by means of feeder mechanism 20 having multiple teeth or projections 21 formed thereon.

The presser foot 10 typically has a flat middle section 11 and an upwardly curved front section 12. It is noted that presser feet have many different shapes in the art and that the principles of the present invention are applicable to virtually all presser feet currently manufactured.

The presser foot 10 also typically has an aperture 17 formed therein for the passage of needle 15 which is mounted to a needle bar or needle actuator 16.

When feeder mechanism 20 pulls the material 30 rapidly through the stitching area, upper material layer 31 tends to be held back or bunched up by the presser foot 10. It thus becomes desirable to lubricate the underside of presser foot 10 and such is currently done by spraying a silicone lubricant which must be manually held by the machine operator.

In the present invention, a small metal tube 40 is secured to the curved front section 12 of the presser foot such that the outlet of tube 40 lies flush with the underside 14 of the front of the presser foot.

The metal tube 40 is soldered, brazed, welded or otherwise securely attached to the presser foot as indicated at numeral 45.

Tubing 50 is then friction fit over metal tube 40 to achieve a desired lubricant flow from a reservoir 60.

A variable flow rate valve 52 is utilized in line 50 to achieve lubricant flow rates as low as 1–2 drops per minute. Valve 52 is easily adjusted by the machine operator as desired.

Numeral 51 represents a shut-off valve or clip means which is used to completely shut off lubricant flow. For example, if the flow setting on valve 52 has been selected and is desired to be used over an extended period of time, the operator can simply use the complete shut-off means 51 at the end of a work day so that, when work resumes on a succeeding day, it is not necessary to re-adjust the variable flow valve 52.

Reservoir 60 of course contains any suitable lubricating fluid such as the silicone lubricants of the art.

Reservoir 60 has a handle means 61 formed thereon for convenient mounting to an available support element 70.

The tubing 50 and reservoir 60 may be made of plastics materials such as those currently used in intravenous feeding bags. Of course, materials other than plastics may be utilized and still fall within the spirit and scope of the present invention.

It will thus be appreciated by those of skill in the art that a constant and low flow rate of lubricant is supplied to the underside 14 of the front of presser foot 10 without the manual spray or complex mechanical systems of the prior art.

It is again emphasized that the present invention may be utilized in conjunction with virtually all presse feet currently being manufactured.

As shown in FIG. 1, tubing 40 is of relatively short length so that, when tubing 50 is disconnected therefrom, the sewing machine can continue to be used safely by the operator. Typically, the length of tube 40 is no longer than one-half the total length of presser foot 10.

As also illustrated in FIG. 1, the right-hand side of tubing 40 is slightly longer than the lefthand side thereof. With such design, the lubricating droplets in tube 40 tend to readily flow along the surface 14 via the principles of capillary attraction as is known in the fluid mechanics arts.

While there has been illustrated and described what is at present considered to be a preferred embodiment of the present invention, it will be appreciated that numerous changes and modifications are likely to occur to those skilled in the art, and it is intended herein to cover all those changes and modifications which fall within the true spirit and scope of the present invention.

For example, numerous tuning and tube fitting arrangements could be utilized to accomplish lubricant conveyance to the presser foot in place of that shown at numerals 50 and 40. Further, compressed air may be utilized as the presser foot lubricant being fed through the tubing 50 and still fall within the spirit and scope of the present invention.

We claim:

1. In combination with a sewing machine having a stitching needle (15), at least one presser foot (10) and a feeder mechanism (20)

said presser foot (10) having a substantially flat middle section (11) and an upwardly curved front section (12), wherein said upwardly curved front section (12) has an underside (14) formed therein, means for lubricating the underside (14) of said presser foot comprising a tube element (40) secured directly to said presser foot front section (12), lubricant resevoir means whereby a lubricating flow therefrom passes directly to the underside (14) of said presser foot (10), wherein said tube element (40) is comprised of metal and a lower end thereof is secured directly to said presser foot front section (12) by welding, brazing or soldering (45), wherein the lower end of said tube element (40) is secured to said presser foot (12) such that it lies flush with the underside (14) of the upwardly curved front section (12) (10), wherein said tube element (40) has an upper end and wherein a second tube element (50) is attached to said upper end of said tube element (40), wherein said second tube element (50) is comprised of flexible material to accommodate the upward and downward motion of the presser foot (10), wherein said second tube element (50) has variable flow valve means (52) therein to control the flow of lubricating fluid to the underside (14) of said presser foot, wherein said second tube element (50) has shut-off valve means (51) associated therewith so that a selected flow rate position in said variable flow valve means (52) may be retained for subsequent use while stopping the flow of lubricant, wherein said second tube element (50) has an upper end to which is attached the lubricant reservoir (60), wherein said lubricant reservoir (60) has handle means (61) formed thereon to provide mounting onto any suitable support (70), wherein said tube element (40) is relatively short in length whereby said second tube element (50) may be disconnected therefrom and wherein said presser foot (10) may continue to perform its intended function as part of a sewing machine.

* * * * *